United States Patent [19]

Hurley et al.

[11] 3,979,863

[45] Sept. 14, 1976

[54] MODULAR PRECAST CONCRETE WALL PANELS IN BUILDING CONSTRUCTION

[75] Inventors: Julius Hurley, Hallandale; Alex Sommers, North Miami Beach, both of Fla.

[73] Assignee: Bearingwall Systems, Inc., Hollywood, Fla.

[22] Filed: May 30, 1975

[21] Appl. No.: 582,093

[52] U.S. Cl. ..... 52/92; 52/583

[51] Int. Cl.[2] ..... E04C 1/10

[58] Field of Search ..... 52/583, 584, 92, 227, 52/578, 582

[56] References Cited

UNITED STATES PATENTS

| | | | |
|---|---|---|---|
| 2,592,634 | 4/1952 | Wilson | 52/583 |
| 3,683,578 | 8/1972 | Zimmerman | 52/583 |
| 3,861,100 | 1/1975 | Fatosme | 52/582 |

*Primary Examiner*—J. Karl Bell

*Attorney, Agent, or Firm*—Oltman and Flynn

[57] ABSTRACT

In a building, reinforced concrete wall panels are bolted to each other and to the floor and roof to provide the outer shell of the building. At the bolt holes in these wall panels a rigid reinforcing rod framework, which is cast in the concrete panel, provides at least one pair of rods passing respectively on opposite sides of each bolt hole to reinforce the panel there. Certain of the wall panels have window openings for receiving standard size, aluminum frame windows. Others of the wall panels provide doorway openings for receiving standard width doors. Preferably, at each outside corner of the building a special corner wall panel is provided.

12 Claims, 19 Drawing Figures

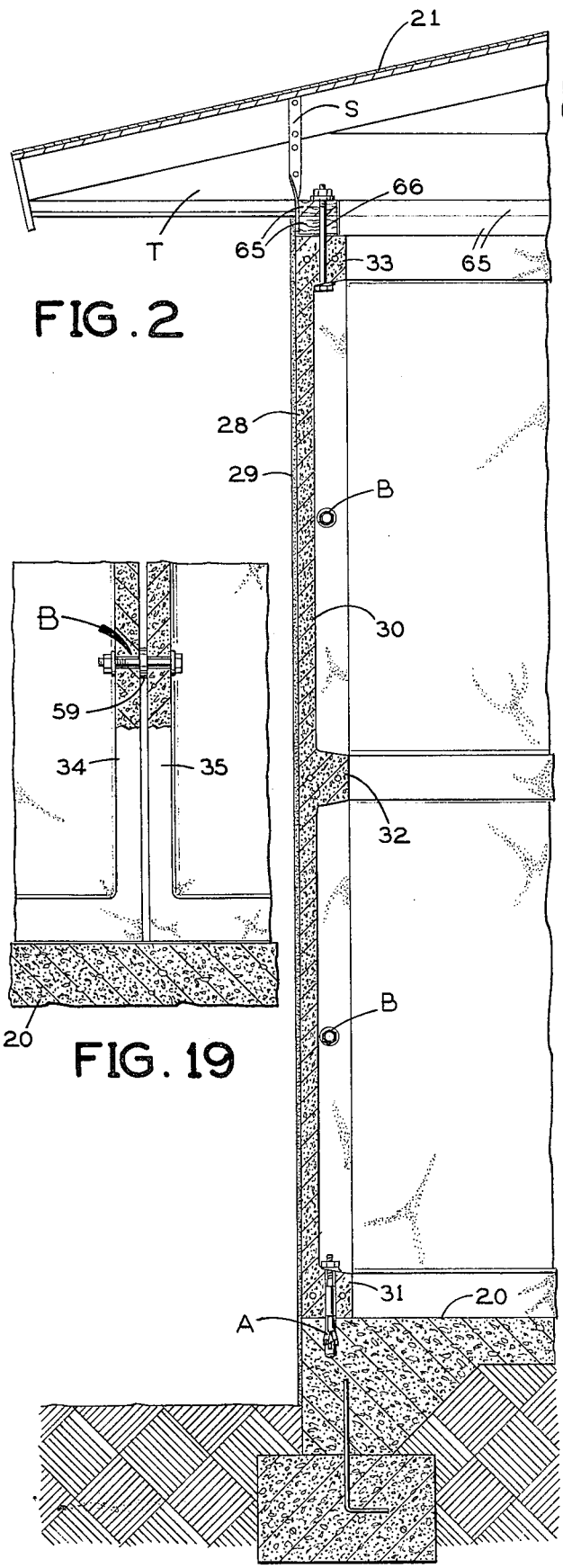
FIG. 2
FIG. 19
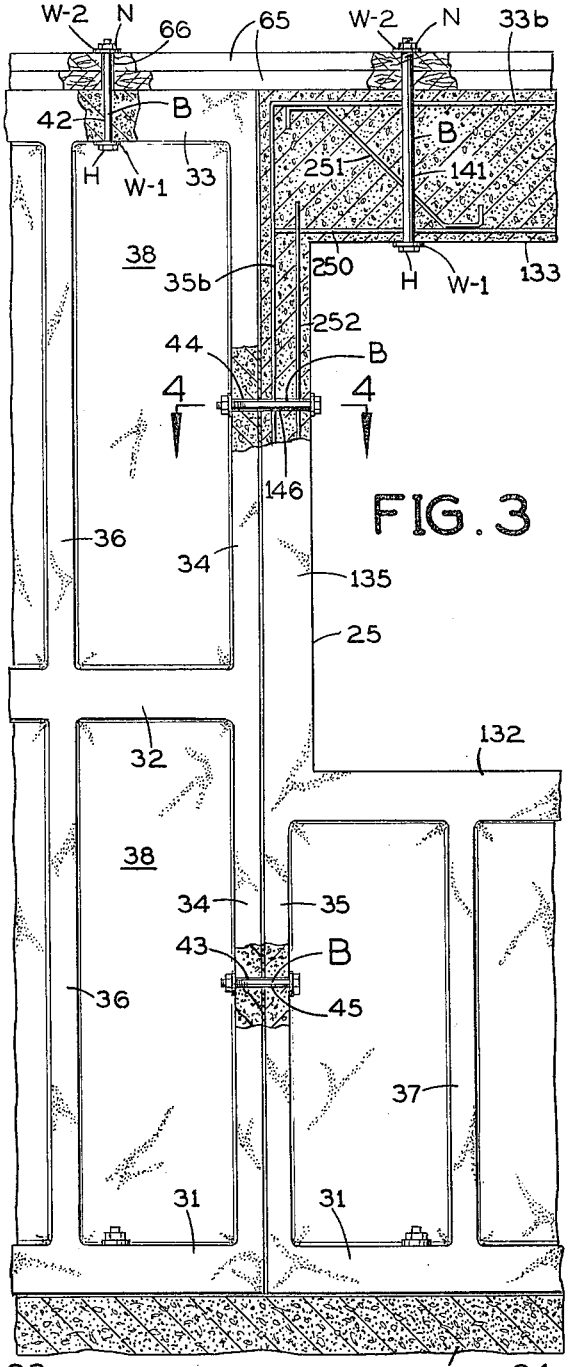
FIG. 3
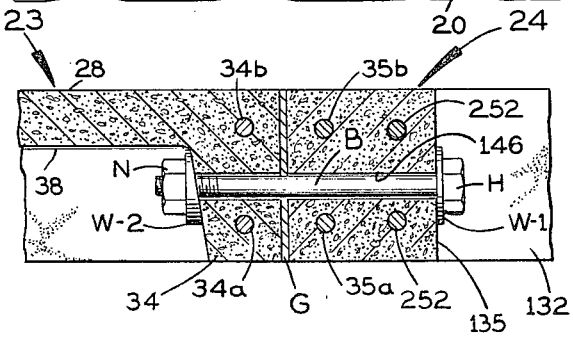
FIG. 4

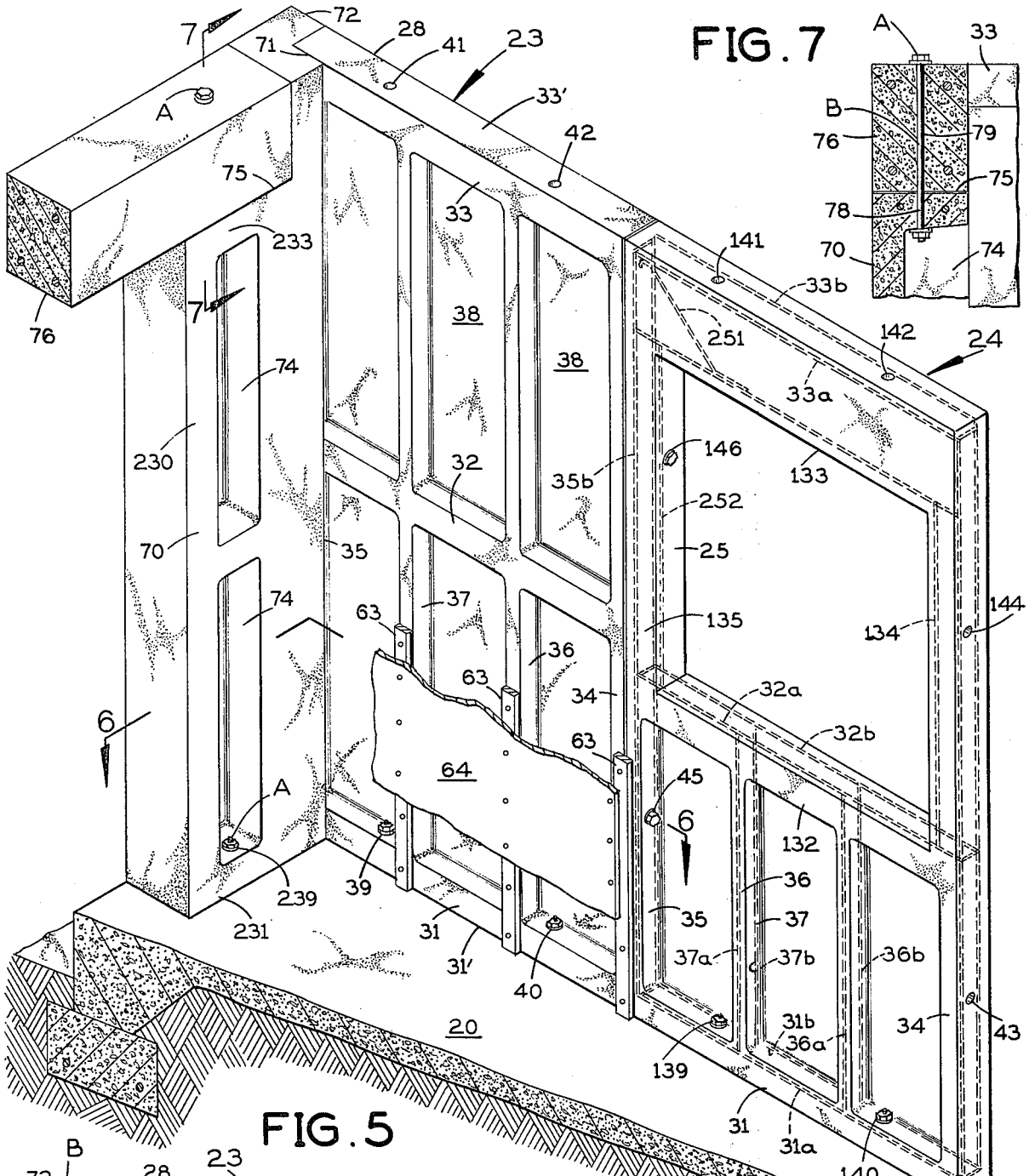
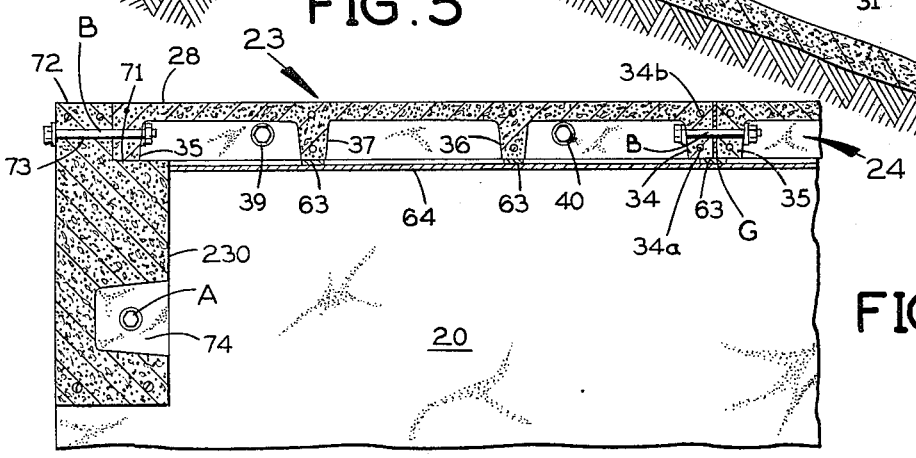
FIG. 6

FIG. 9
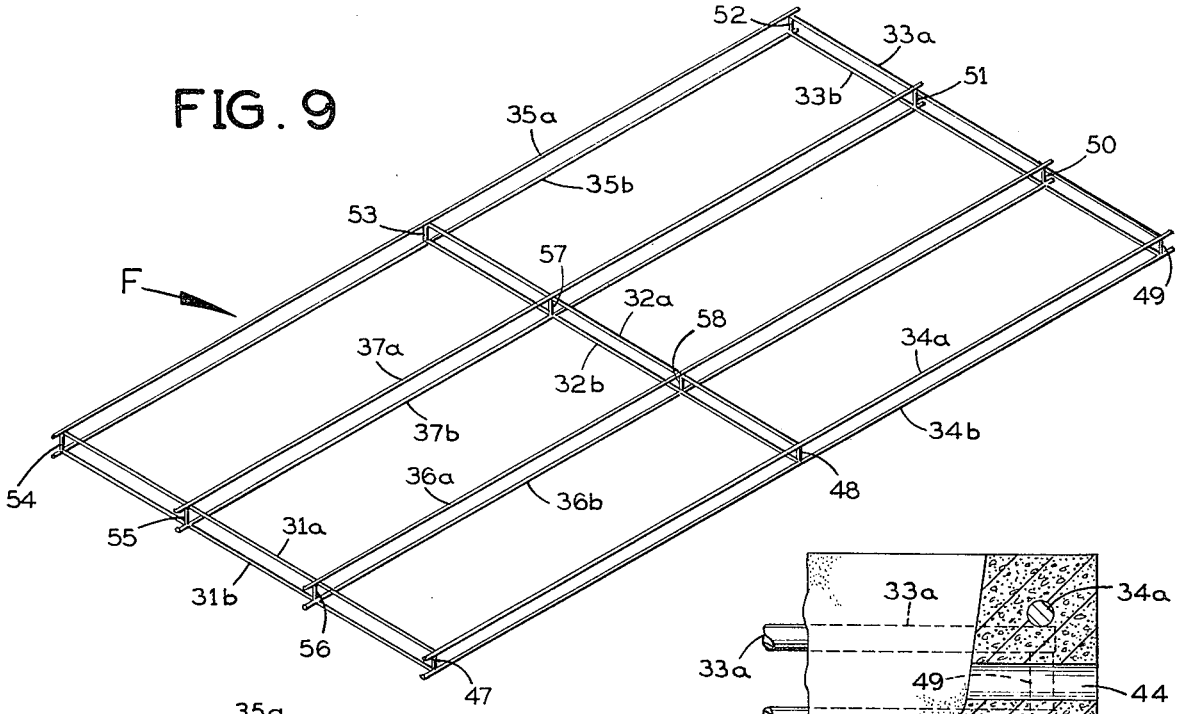
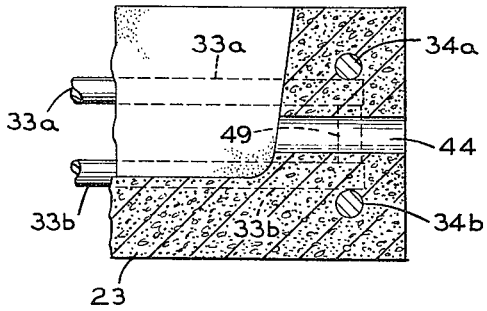
FIG. 10
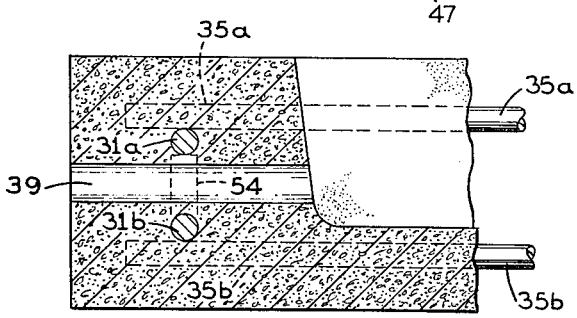
FIG. 11
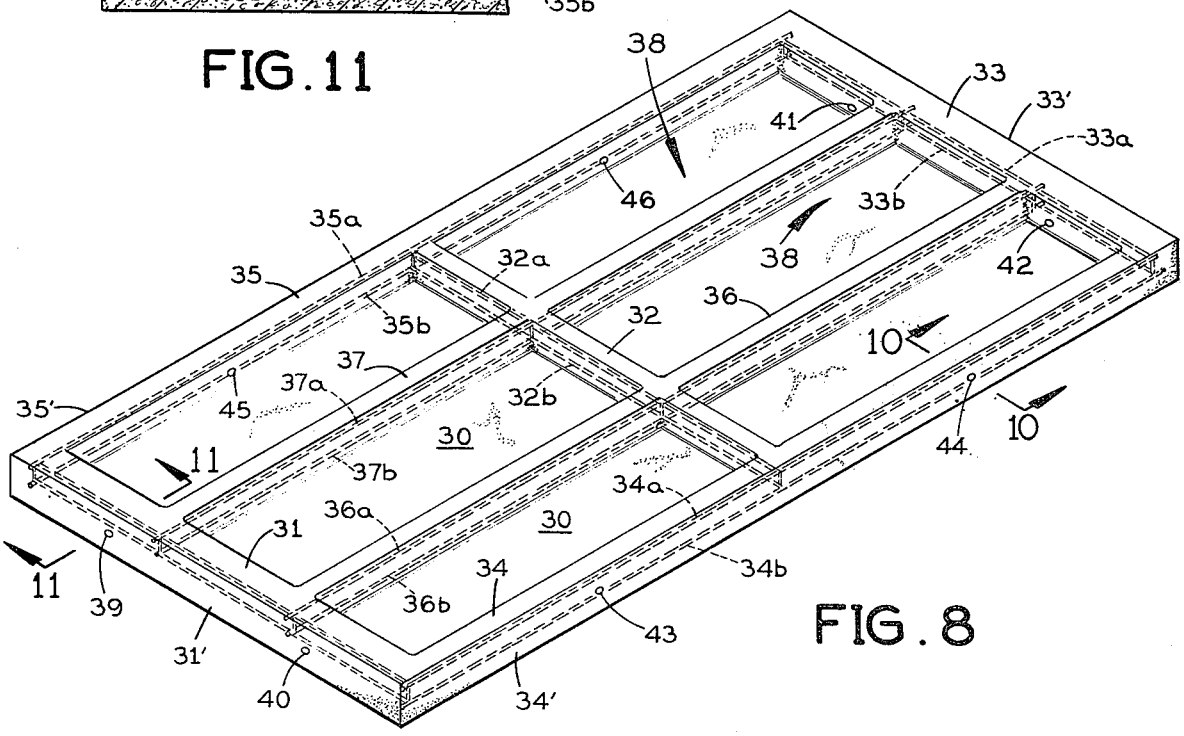
FIG. 8

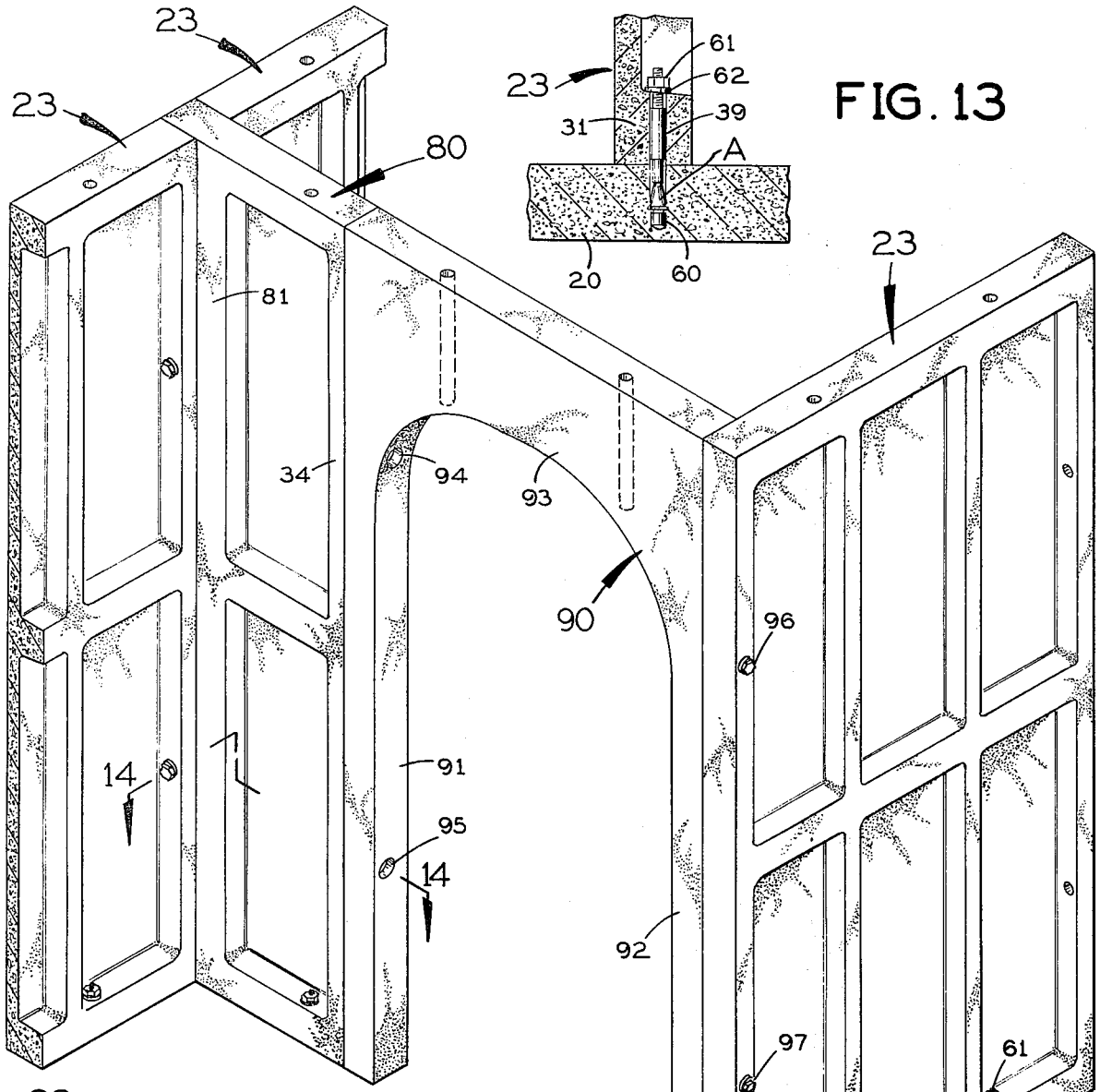
FIG. 12
FIG. 13
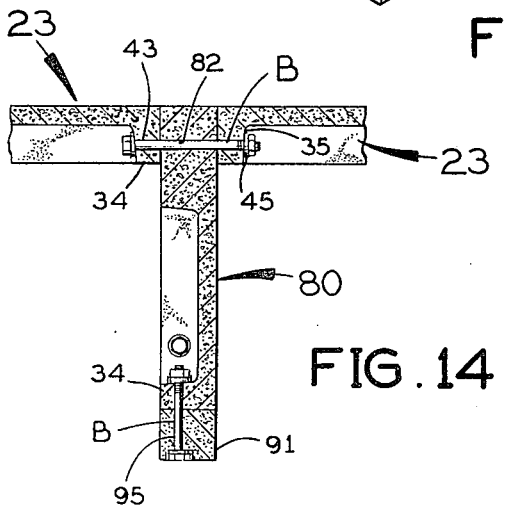
FIG. 14

FIG. 15
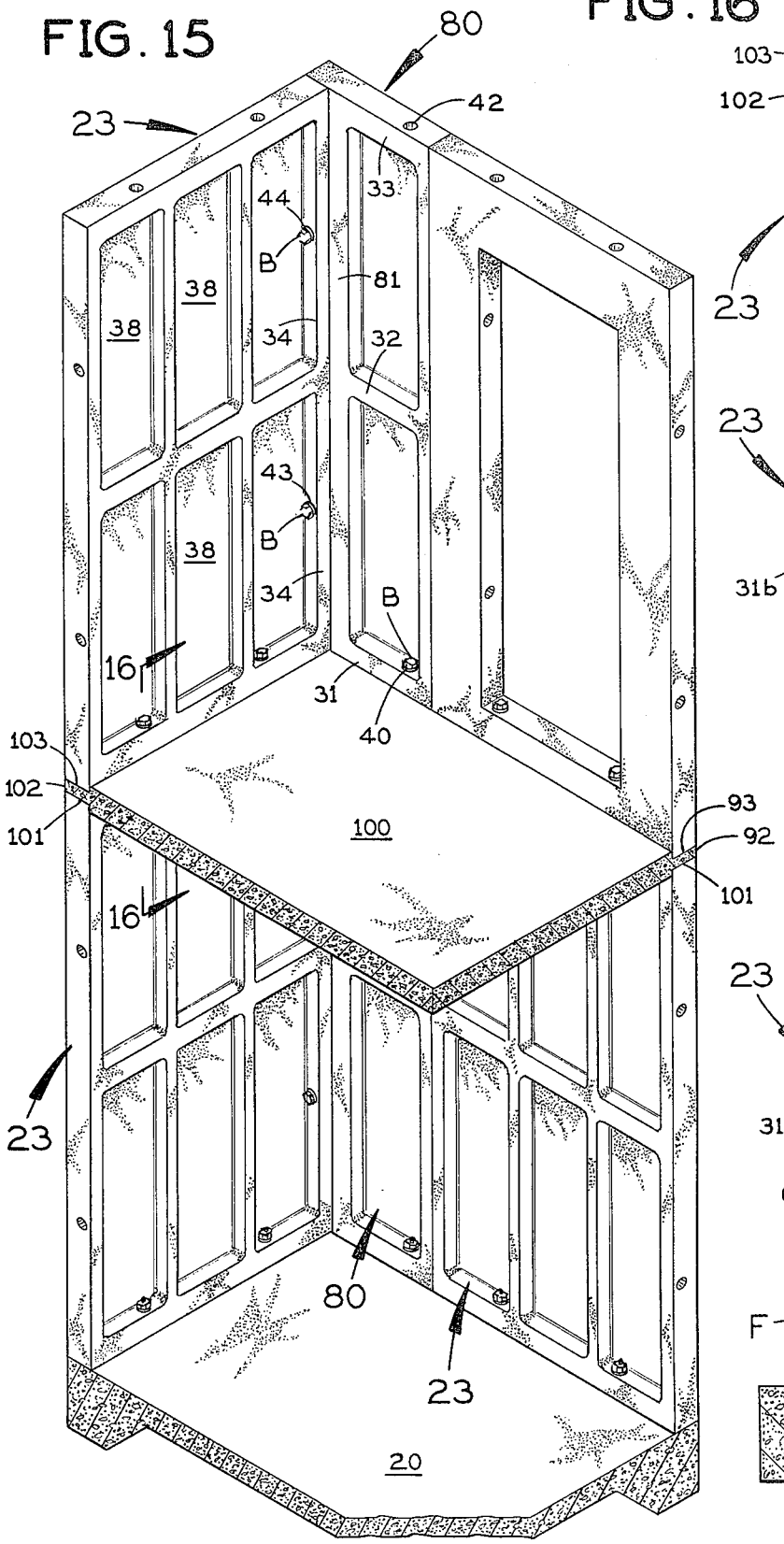
FIG. 16
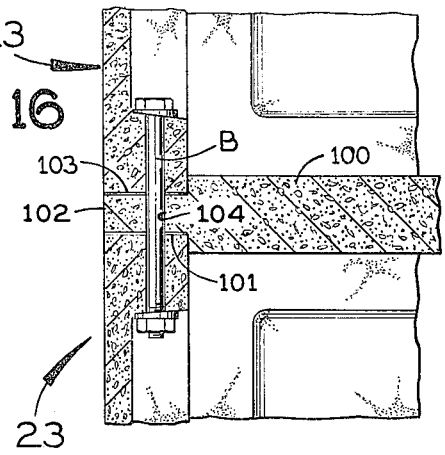
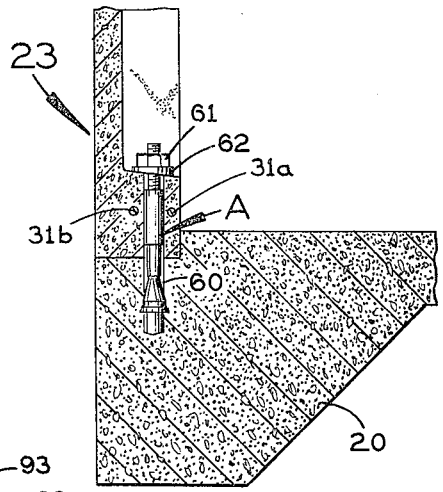
FIG. 17
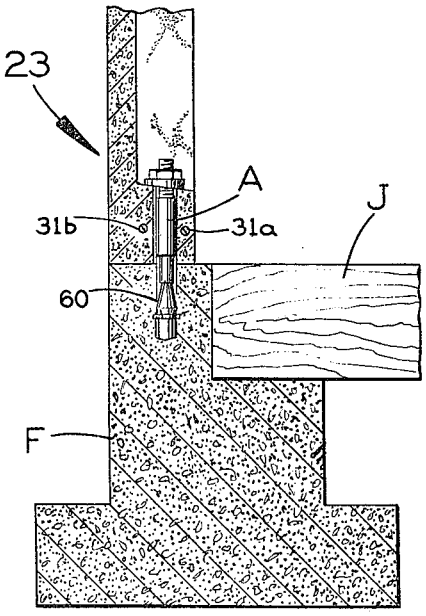
FIG. 18

MODULAR PRECAST CONCRETE WALL PANELS IN BUILDING CONSTRUCTION

BACKGROUND OF THE INVENTION

Various proposals have been made heretofore for constructing a building (either a single-story building or a multistory building) with precast concrete wall panels. One such proposal is disclosed in U.S. Pat. No. 2,592,634 to J. H. Wilson. For various reasons these previous proposals have not received substantial acceptance, principally because of the complexity and cost of constructing such buildings despite the ostensible advantages of their prefabricated modular designs.

SUMMARY OF THE INVENTION

The present invention is directed to a novel and improved precast concrete wall panel construction which enables the shell of a building to be erected at substantially lower cost and in a shorter time and yet meets stringent building code requirements, such as those imposed in south Florida for withstanding hurricanes and those imposed in California to withstand earthquakes.

A principal object of this invention is to provide a novel and improved precast concrete wall panel which is especially well suited for use with similar wall panels to provide the outside walls of a building.

Another object of this invention is to provide a building structure comprising a plurality of such wall panels bolted to each other to provide the outside walls of the building.

Another object of this invention is to provide such a building structure which substantially reduces the time, expense and workmen's skills needed to erect the outside shell of a building.

Further objects and advantages of this invention will be apparent from the following detailed description of presently-preferred embodiments of the present wall panel, used in single-story and multi-story building structures which are shown in the accompanying drawings, in which:

FIG. 2 is a vertical section taken along the line 2—2 in FIG. 1 and showing the attachments of one of the modular wall panels to the concrete floor and to the roof of the building;

FIG. 3 is a vertical elevational view, taken from inside the building and with certain parts broken away and shown in section for clarity, showing the attachments between two adjoining modular wall panels in this building;

FIG. 4 is a horizontal section taken along the line 4—4 in FIG. 3 at one of the attachment bolts holding two adjoining wall panels together;

FIG. 5 is a fragmentary perspective view taken from inside the building and showing the wall panel construction at the left front corner of the garage in FIG. 1;

FIG. 6 is a horizontal section taken along the line 6—6 in FIG. 5;

FIG. 7 is a vertical section taken along the line 7—7 in FIG. 5;

FIG. 8 is a perspective view of one of the modular wall panels in accordance with the present invention, showing the embedded reinforcing framework in phantom;

FIG. 9 is a perspective view of the reinforcing framework which is cast in the wall panel of FIG. 8;

FIG. 10 is a section taken along the line 10—10 in FIG. 8;

FIG. 11 is a section taken along the line 11—11 in FIG. 8;

FIG. 12 is a fragmentary perspective view taken from inside the building, showing the manner in which an inside wall is joined to an outside wall;

FIG. 13 is a vertical section taken along the line 13—13 in FIG. 12 and showing how one of the inside wall panels is bolted to the concrete floor of the building;

FIG. 14 is a horizontal section taken along the line 14—14 in FIG. 12;

FIG. 15 is a fragmentary perspective view taken from the inside of a multi-story building constructed with the wall panels of the present invention and showing an outside corner of the building;

FIG. 16 is a vertical section taken along the line 16—16 in FIG. 15 and showing the attachment of the second-story floor to the first and second-story outside wall panels;

FIG. 17 is a vertical section showing how one of the first-story outside wall panels is bolted to a monolithic concrete floor slab;

FIG. 18 is a view similar to FIG. 17 for a floor having wooden joists on a poured concrete footing; and FIG. 19 is a fragmentary elevational view taken from inside the building and showing an alternative arrangement for bolting together two adjoining outside wall panels.

Figure 1:
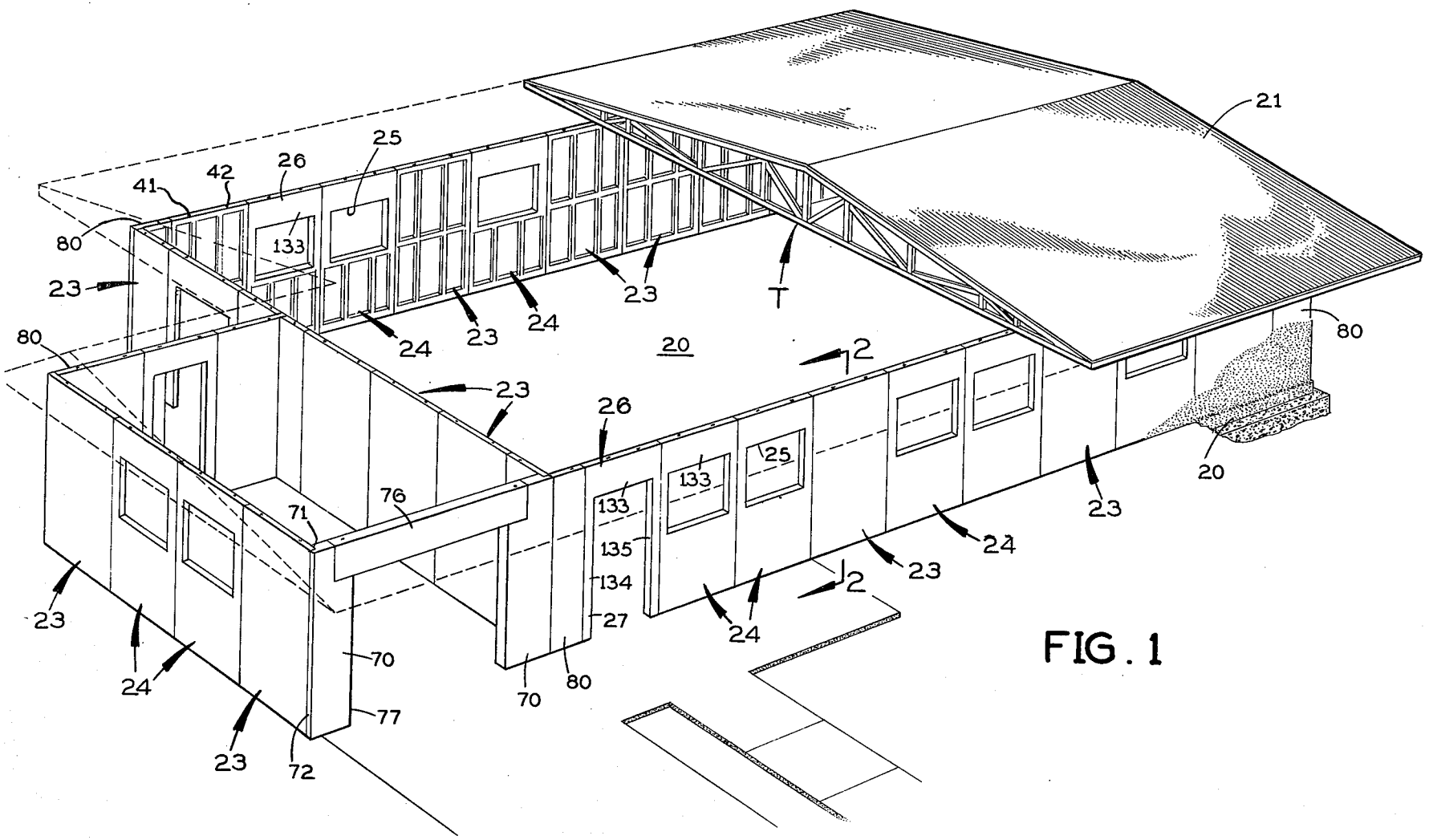
FIG. 1 is a perspective view of the outer shell of a one-story building with attached garage, constructed with modular, precast concrete wall panels in accordance with the present invention with part of the roof removed for clarity.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Referring first to FIG. 1, the one-story building shell shown there comprises a poured concrete floor 20, a roof 21, and a plurality of vertically disposed, rectangular, reinforced concrete, wall panels according to the present invention which extend from the floor up to the roof around the entire periphery of the building. These wall panels include:

standard wall panels 23 which present neither a window opening nor a doorway opening;
window panels 24, each of which presents a single rectangular window opening 25;
door panels 26, each of which presents a rectangular door opening 27;
and half-width corner panels 80 of special construction, to be described.

Standard Wall Panel 23

The construction of the standard wall panel 23 will be described first. Referring to FIGS. 2 and 5, each panel 23 is a cast, one-piece, reinforced concrete body having a flat, vertical outer face 28, which in the finished building may be coated with a layer 29 of stucco or other surface finish. At the inside of the building this panel presents a generally flat, vertical inner face 30 and reinforcing ribs extending behind this inner face. These reinforcing ribs include:

a horizontal rib 31 extending along the bottom of the panel;
a horizontal rib 32 located midway up along the panel;
a horizontal rib 33 extending along the top of the panel;
vertical side edge ribs 34 and 35 (FIG. 8) extending along the opposite side edges of the panel;
and intermediate vertical ribs 36 and 37 located at even intervals between the opposite side edge ribs.

With this arrangement, the panel presents six rectangular recesses 38 which are open at its inner side between the ribs 30–37, as best seen in FIG. 5. The bottom rib 31 and the top rib 33 present flat, horizontal outer (lower and upper) faces 31' and 33', (bottom and top faces, respectively), and the side edge ribs 34 and 35 present flat, vertical outer faces 34' and 35', respectively, which together define the rectangular periphery of the panel.

In accordance with the present invention, the standard panel 23 contains a reinforcing framework F (FIG. 9) composed of interconnected pairs of steel rods extending lengthwise of the ribs 30–37. This framework is positioned in the casting mold for the panel, and then the concrete is poured into the mold, solidifying around the framework F so that they form an integral monolithic structure. When the concrete is poured, pins are positioned in the mold at the locations of the respective outer ribs 31, 33, 34 and 35, extending parallel to the major faces 28 and 30 of the panel and perpendicular to the outer side edge faces of the respective ribs, so as to form circular openings or bolt holes in these ribs as follows (FIG. 8):

vertical opening 39 in the bottom rib 31 between the vertical ribs 35 and 37;
vertical opening 40 in the bottom rib 31 between the vertical ribs 34 and 36;
vertical opening 41 in the top rib 33 between the vertical ribs 35 and 37;
vertical opening 42 in the top rib 33 between the vertical ribs 34 and 36;
lower horizontal opening 43 in the side edge rib 34 between the bottom rib 31 and the middle horizontal rib 32;
upper horizontal opening 44 in the side edge rib 34 between the middle rib 32 and the top rib 33;
lower horizontal opening 45 in the side edge rib 35 between the bottom rib 31 and the middle horizontal rib 32;
and upper horizontal opening 46 in the side edge rib 35 between the middle rib 32 and the top rib 33.

Each of these openings 39–46 extends completely through the respective rib and is accessible from the panel recess 38 at the inner side of the rib. FIG. 10 shows the side edge rib 34 in cross-section at the opening 44. FIG. 11 is a similar view of the bottom rib 33 at the latter's opening 39.

The reinforcing framework F (FIG. 9) in the panel comprises:

a lower pair of horizontally elongated rods 31*a* and 31*b* which are embedded in the bottom rib 31 of the wall panel;
a middle pair of horizontally elongated rods 32*a* and 32*b* which are embedded in the middle horizontal rib 32 of the wall panel;
an upper pair of horizontally elongated rods 33*a* and 33*b* which are embedded in the top rib 33 of the wall panel;
a first outside pair of vertically elongated rods 34*a* and 34*b* which are embedded in the rib 34 at one side edge of the panel and are joined directly to the adjacent ends of the horizontal rods 31*a*, 32*a*, 33*a* and 31*b*, 32*b*, 33*b*, respectively;
a second outside pair of vertically elongated rods 35*a* and 35*b* which are embedded in the opposite side edge rib 35 of the panel and are joined directly respectively to the adjacent ends of the horizontal rods 31*a*, 32*a*, 33*a* and 31*b*, 32*b*, 33*b*;
a first inside pair of vertically elongated rods 36*a* and 36*b* which are embedded in the inside vertical rib 36 of the panel and are joined directly to the horizontal rods 31*a*, 32*a*, 33*a* and 31*b*, 32*b*, 33*b*, respectively, where they intersect;
and a second inside pair of vertically elongated rods 37*a* and 37*b* which are embedded in the other inside vertical rib 37 of the panel and are joined directly to the respective horizontal rods 31*a*, 32*a*, 33*a* and 31*b*, 32*b*, 33*b* where they intersect.

The reinforcing framework F also has short, transverse rod segments interconnecting the elongated rods at each corner and each other intersection, as follows:

rod segment 47 at the corners between rods 31, 34*a* and 31*b*, 34*b* respectively;
rod segment 48 at the intersections between rods 32*a*, 34*a* and 32*b*, 34*b*, respectively;
rod segment 49 at the corners between rods 33*a*, 34*a* and 33*b*, 34*b*, respectively;
rod segment 50 at the intersections between rods 33*a*, 36*a* and 33*b*, 36*b*, respectively;
rod segment 51 at the intersections between rods 33*a*, 37*a* and 33*b*, respectively;
rod segment 52 at the corners between rods 33*a*, 35*a* and 33*b*, 35*b*, respectively;
rod segment 53 at the intersections between 35*a*, 32*a* and 35*b*, 32*b*, respectively;
rod segment 54 at the corners between rods 35*a*, 31*a* and 35*b*, 31*b*, respectively;
rod segment 55 at the intersections between rods 31*a*, 37*a* and 32*a*, 37*b*, respectively;
rod segment 56 at the intersections between rods 31*a*, 36*a* and 31*b*, 36*b*, respectively;
rod segment 57 at the intersections between rods 32*a*, 37*a* and 32*b*, 37*b*, respectively;
and rod segment 58 at the intersections between rods 32*a*, 36*a*, and 32*b*, 36*b*, respectively.

With this construction the short rod segments 47–58 position the elongated rods of each pair parallel to each other. In the finished panel, the rods of each outside pair, 31*a*–31*b*, 33*a*–33*b*, 34*a*–34*b*, and 35*a*–35*b*, are disposed on opposite sides of the respective openings 39–46 in the corresponding peripheral ribs 31–35 of the panel. As explained hereinafter, this paired arrangement of the elongated rods at the outside of the reinforcing framework greatly increases the tensile strength of the panel, reinforces the peripheral ribs on the panel where it will be bolted to adjoining panels or other structural members, such as the floor or the roof, and stabilizes the positions of the openings 39–46 in these ribs to insure that the openings in one panel will be lined up precisely with the openings in the next panel.

Window Panel 24

Each panel 24 which provides a window opening 25 has the same external dimensions and rectangular configuration as the wall panel 23. The window opening 25 is dimensioned to snugly receive a standard size, aluminum frame window.

As best seen in FIG. 5, this panel 24 at the inside of the building presents a horizontal bottom rib 31, which is identical to the similarly numbered bottom rib on the standard wall panel 23, vertical, opposite side edge ribs 34 and 35 and vertical inside ribs 36 and 37, which are identical to the corresponding vertical ribs on the standard wall panel 23 except that they extend up from the bottom rib for only slightly less than half the height of panel 24, up to a middle horizontal rib 132 at the bottom of the window opening 25. From this middle rib 132 upward, and around the periphery of the window opening, the panel 24 has a uniform front-to-back thickness (between the outside and inside major faces of the panel) equal to its thickness at the lower ribs 31, 34, 35, 36 and 37. At this upper section of the panel, it presents a pair of vertically elongated side edge segments 134 and 135, which extend up from opposite ends of the middle rib 132, and a horizontally elongated top segment 133, which extends between the upper ends of the side edge segments 134 and 135. The side edge segments 134 and 135 are substantially thicker horizontally parallel to the major faces of this panel than are the corresponding side edge ribs 34 and 35 below. The top segment 133 is substantially thicker vertically than the bottom rib 31 on this panel.

This window panel provides two vertical openings at 39 and 40 in the bottom rib 31 at the same positions along this bottom rib as the corresponding bottom openings in each standard wall panel 23, which has already been described in detail.

The window panel 24 also has two vertically spaced, horizontal openings at 45 and 146 in the lower side edge rib 35 and the upper side edge segment 135, respectively, at one side of the panel. These openings 45, 146 register with the openings 43 and 44, respectively, in the adjoining wall panel 23, as best seen in FIG. 3.

The window panel also has two vertically spaced, horizontal openings 43 and 144 in the lower side edge rib 34 and the upper side edge segment 134, respectively, at the opposite side of the panel. These openings register with openings in the adjacent side edge of an adjoining panel. For example, these would be the openings 45 and 46 in standard wall panel 23 if the adjoining panel were of that design (FIG. 5).

The window panel 24 has two horizontally spaced, vertical openings 141, 142 in the top segment 133 at the same positions laterally of this panel as the top openings 41, 42 in the standard wall panel 23 (FIG. 5).

When the window panel 24 is cast in a mold, the mold core will, of course, be different from the mold core used in the formation of the standard wall panel 23. When the concrete for the window panel is poured, a reinforcing rod framework will be positioned in the mold. This framework is shown in dashed lines in the window panel in FIG. 4, from which it will be apparent that this framework has a double-rod construction, like that shown in FIG. 9, but modified to fit the window panel in which it is embedded. The reinforcing framework in the window panel provides:

two horizontally elongated lower rods 31*a* and 31*b* embedded in the bottom rib 31 of this panel and extending on opposite sides (in the front-to-back direction) of the openings 39 and 40 in this bottom rib.

two horizontally elongated middle rods 32*a* and 32*b* embedded in the middle rib 132;

two horizontally elongated upper rods 33*a* and 33*b* embedded in the top segment 133 of the window frame and passing on opposite sides (from front to back) of the latter's vertical openings 141 and 142;

two vertically elongated outside rods 35*a* and 35*b* embedded in and running lengthwise of the lower side edge rib 35 and the upper side edge segment 135 at the left side of panel 24 in FIG. 6 and passing on opposite sides (from front to back) of the latters' respective horizontal openings 45 and 146;

two vertically elongated outside rods 34*a* and 34*b*, which are embedded in and run lengthwise of the lower side edge rib 34 and the upper side edge segment 134 and which pass on opposite sides (from front to back) of the latters' resepctive horizontal openings 43 and 144;

a first pair of vertically elongated inside rods 36*a* and 36*b*, which are embedded in and run lengthwise of the inside lower rib 36 on panel 24;

and a second pair of vertically elongated inside rods 37*a* and 37*b*, which are embedded in and run lengthwise of the other inside lower rib 37 on panel 24.

The several elongated rods in this framework intersect one another in the same manner as the framework F in FIG. 9, and the elongated rods of each pair are interconnected by rigid, transverse, short rod segments in the same manner and for the same purpose.

In addition to the foregoing, the reinforcing framework in the window panel 24 has additional pairs of elongated steel rods in the upper half of the panel. As shown in FIG. 3, embedded in the top segment 133 of this panel are two horizontally elongated reinforcing rods 250 (only one of which appears in FIG. 3). These horizontal rods 250 are spaced vertically below the upper rods 33*a* and 33*b* and they are located respectively on opposite sides (from front to back) of the two vertical openings 141 and 142 in this top segment of the panel. These lower horizontal rods 50 in the top segment of the panel are joined at their opposite ends to the respective vertically elongated reinforcing rods 35*a*, 35*b* and 34*a*, 34*b* at the opposite side edges of the panel.

The two lower horizontal rods 250 in the top segment 133 of the window panel are rigidly connected invidually to the respective horizontal upper rods 33*a* and 33*b* at the top corners of this reinforcing framework by respective connecting rods 251, which pass diagonally on opposite sides (from front to back) of the respective vertical opening 141 or 142 in the top segment 133 of the window panel 24. Accordingly, at each such opening 141 or 142 there are three pairs of reinforcing rods 33*a*–33*b*, 251—251 and 250—250, which extend on opposite sides of that opening at different points along its vertical extent, near its upper end, middle, and lower end, respectively.

This reinforcing rod framework in the window panel 24 also includes in each upper side edge segment 135 and 134 (on opposite sides of the window opening 25 in the panel) a pair of vertically elongated rods 252 (FIG.

3) which are aligned with and spaced laterally inward from the respective outside rods 35*a*, 35*b* and 34*a*, 34*b* of the reinforcing framework. The rods 252 of each pair pass on opposite sides (from front to back) of the opening 146 or 144 in the respective upper side edge segment 135 or 134 of the window panel. With this arrangement, at each opening 144 or 146 there are two pairs of reinforcing rods passing on opposite sides (from front to back) of the opening and spaced apart along the horizontal length of that opening. Each vertical rod 252 is joined to a corresponding horizontal rod 250 near its upper end and to a corresponding horizontal middle rod 32*a* or 32*b* near its lower end for purposes of rigidity.

Door Panel 26

Each panel 26 (FIG. 1) which provides a doorway opening 27 has the same external dimensions and rectangular configuration as the standard wall panel 23 and the window panel 24.

The horizontal width of the doorway opening 27 in panel 26 is the same as that of the window opening 25 in the window panel 24, and the top edge of this doorway opening is at the same vertical position as the top edge of the window opening. The door panel 26 has a uniform thickness for its entire extent, equal to the thickness of the upper half of the window panel 24 around the window opening 25 therein. Consequently, the door panel 26 presents a top segment 133 and a pair of opposite side edge segments 134 and 135 which extend the full height of the door panel. The segments 133, 134 and 135 of the door panel have the same cross-sectional configurations and dimensions as the correspondingly numbered segments of the window panel 24.

The door panel 26 has a rigid framework composed of paired reinforcing rods arranged in the same fashion as those shown and described with reference to the upper half of the window panel 24.

The door panel has two horizontally spaced vertical openings 141, 142 in its top segment 133 which are identical to the correspondingly numbered openings in the window panel. In this top segment of the door panel, three pairs of reinforcing rods pass on opposite sides of each top opening 141, 142 at spaced points along the vertical extent of the opening, in the same manner as in the window panel.

At each side edge the door panel has two vertically spaced, horizontal, upper and lower openings which are located respectively at the same vertical positions as the side edge openings 46, 45 or 44, 43 in the standard wall panel 23. In each side edge segment 134 or 135 of the door panel, two pairs of reinforcing rods pass vertically on opposite sides of each such horizontal opening at spaced points along the horizontal extent of that opening, in the same manner as in the top half of the window panel 24.

Attachment of Adjoining Panels

As already explained, each of the upstanding panels, whether a standard wall panel 23, a window panel 24 or a door panel 26, has two vertically spaced, horizontal, upper and lower openings located at each side edge. These openings are at the same vertical positions at both side edges of each panel, so that the side openings in one panel register with the side openings in the next adjacent panel when the panels are juxtaposed side-by-side, as shown in FIGS. 3–6. In one practical embodiment, the side openings in the panels are ⅝ inch in diameter so that they easily receive a half inch diameter bolt.

As shown in FIGS. 3 and 4, at one registering pair of side openings 44 and 146 in adjoining panels 23 and 24, a half inch bolt B extends through these openings. An enlarged hexagonal head H on one end of the bolt holds a metal washer W-1 against the inner side of the upper side edge segment 135 of panel 24. At the opposite end of the bolt, a nut N is threaded onto the bolt and holds a metal washer W-2 against the inner face of the side edge rib 34 on the other panel 23. A thin layer of epoxy or grout G is interposed between the confronting, neighboring flat side edges of the panels and then the nut is tightened to clamp the panels together side-by-side.

A similar bolt, nut and washer arrangement is provided at the lower side edge openings 43, 45 of these panels (FIG. 3), except that here the bolt is shorter because the lower side edge rib 35 on panel 24 is thinner than the upper side edge segment 135 of this panel.

From FIG. 4 it will be evident that the side edge rib 34 on the standard wall panel 23 is structurally reinforced on opposite sides of the bolt hole 44 by the pair of reinforcing rods 34*a* and 34*b*, and the upper side edge segment 135 of the adjoining window panel 23 is reinforced on opposite sides of the bolt hole 146 by two pairs of reinforcing rods 35*a*–35*b*, and 52—52. Because of such reinforcement, each bolt and nut assembly can be tightened without any danger of structurally damaging the concrete in the panels. Also, the presence of these reinforcing rods on opposite sides of each bolt hole tends to stablilze the positions of the bolt holes so that the holes in the side edge of one panel line up precisely with the holes in the neighboring side edge of an adjoining panel.

The same advantageous results are provided at the lower openings 43, 45 in the side edges of these panels where, in both cases, a single pair of reinforcing rods pass on opposite sides of each bolt hole.

It will be understood that the bolt-and-nut attachment of one panel to the next along a straight outside wall is essentially the same as just described for any pair of panels 23, 24 or 25 of the same type or different types.

FIG. 19 shows a modified arrangement in which a thin, annular, flat, steel or plastic washer 59 is sandwiched between the adjacent side edges of each pair of adjoining wall panels at each attachment bolt B. The bolt passes through this washer, but in other respects the bolt and nut assembly is the same. Preferably, these washers 59 are 1/8 thick, and the space between adjoining wall panels is caulked after the erection of the walls.

Wall Panel Attachment To The Floor

A plurality of vertical holes 60 (FIG. 17) are drilled in the monolithic slab, concrete floor 20 at the locations of the respective bottom openings 39, 40 in the upstanding panels. In one practical embodiment, these floor holes and the bottom openings in the panels are three-quarters inch in diameter. A ⅝ inch diameter wedge anchor A of known design is inserted into each floor hole 60. The bolt shank of this anchor extends up through the corresponding bottom opening in the panel (e.g., the opening 39 in the bottom of wall panel 23 in FIG. 10). A nut 61 is threaded onto the upper end of this bolt and holds a metal washer 62 down against the inside (top) face of the bottom rib 31 of this panel. By tightening this nut, the anchor A is expanded to securely grip the floor 20 at the opening 60 in the usual manner.

Two such floor anchors A are provided at the bottom of each upstanding panel 23, 24 or 25 to attach it securely to the concrete floor.

At each floor anchor, the bottom rib of the panel has two reinforcing rods 31*a*, 31*b* which extend on opposite sides of the respective bottom openings in that panel to reinforce the panel there and stabilize the positions of these openings, as already described.

Referring to FIG. 18, if the floor has wooden floor joists J resting on concrete footings F (instead of the monolithic concrete slab of FIG. 17), the anchor openings 60 are drilled in the top of the footings to receive the anchors A, in the same manner as just described, for bolting the wall panels to these footings.

After the wall panels have been attached to the floor, furring strips 63 (FIG. 5) may be attached to the vertical ribs 34–37 of the panels and then wallboard panels 64 may be attached to the furring strips to cover each wall panel at the inside of the building, or a lath-and-plaster wall may be provided.

Wall Panel Attachment to Roof

The roof 21 of the building is mounted on a plurality of wooden trusses T which are spaced apart at intervals from left to right in FIG. 1. As shown in FIG. 3, a pair of wood two-by-fours 65 extend along the top of each outside wall, directly overlying the horizontal top edges of the successive panels 23, 24 or 26 which make up this wall. A metal anchor strap S (FIG. 2) is wrapped around these two-by-fours and extends up for attachment to the roof truss T.

Vertical holes 66 are drilled in the two-by-fours 65 at the location of each top opening 41, 42 or 141, 142 in the underlying outside wall panel. In one practical embodiment, these holes and openings are all ¾ inch in diameter. A ⅝ inch diameter bolt B is provided at each top opening in the panels, with its hex head H holding a metal washer W-1 up against the inside (lower) face of the top rib 33 or top segment 133 of the respective panel. A nut N is threaded onto the upper end of this bolt and holds a metal washer W-2 down against the top of the uppermost two-by-four 65.

At each such clamping bolt and nut assembly in the wall panels there are two reinforcing rods 33*a* and 33*b* in the top rib 33 or top segment 133 of the panel, passing on opposite sides of the respective top opening in that rib.

At the window panels 24 and the door panels 26, there are three pairs of such reinforcing rods 33*a*–33*b*, 251—251, and 250—250, with the rods in each pair passing on opposite sides of the top openings in that panel.

Thus, the concrete in the panel is adequately reinforced in the vicinity of these top openings and the positions of these openings are stabilized in the manner already described.

Corner Construction

FIG. 5 shows, from the inside of the building, the special corner construction at the left front corner of the FIG. 1 building which, it will be evident, is at the front of the garage.

An upstanding concrete corner panel 70 at the front of the building extends perpendicular to the first wall panel 23 on the adjacent side of the house. In one practical embodiment panel 70 is half the width and twice the thickness (between its outside and inside major faces) of a standard wall panel 23. The corner panel 70 presents along one side edge 72 a rectangular recess 71 which is open at the inside major face 230 of this panel and has a depth (from left to right in FIG. 5) equal to the thickness of the standard wall panel 23 at its ribs, so that the side edge rib 35 of this panel fits snugly in this recess 71 and the outside major face 28 of panel 23 is flush with this side edge 72 of panel 70, as best seen in FIG. 6.

Just beyond this recess 71, the corner panel 70 is formed with two vertically spaced, horizontal, upper and lower holes 73 (FIG. 6) registering respectively with the holes 45 and 46 in the side edge rib 35 of the standard wall panel 23 which fits in this recess. Respective clamping bolts B extend through these aligned sets of holes in the two panels, and they are clamped together here in the same fashion as already described.

The corner panel 70 is formed with upper and lower, rectangular, vertically elongated recesses 74 which are open at its inside major face 230, as best seen in FIG. 5. Below the lower recess 74 this panel has a bottom segment 231 in which a single vertical opening is formed at 239 for passing a floor anchor A, as already described, to fasten this panel to the concrete floor.

The corner panel 70 also is formed with a rectangular recess 75 at the top in which is seated one end of a horizontal, reinforced concrete beam 76 which, as shown in FIG. 1, extends across the top of the garage door opening 77 in the building shell. Immediately below its upper recess 74 the corner panel 70 presents a top segment 233 having a vertical opening 78 (FIG. 7) which registers with a vertical opening 79 in the overlying cross beam 76. A clamping bolt B extends down through these openings 78 and 79 and a nut is threaded onto the lower end of this bolt for holding this end of the cross beam clamped to the corner panel 70.

A similar corner panel 70 is provided at the opposite side of the garage door opening 77, except that this corner panel is a mirror image of the corner panel just described in detail. The opposite end of the cross beam 76 is bolted to this second corner panel in the manner just described and this second corner panel is anchored to the floor in the same fashion as described.

At each of the other corners of the building a corner panel 80 as shown in FIG. 11 may be provided. This corner panel 80 is half the width (from side to side) of the standard-width panels 23, 24 and 26 and it has the same thickness (from front to back). This corner panel has upper and lower recesses 38 at its inner side located respectively above and below a middle horizontal rib 32. A single vertical opening at 40 extends down through the bottom horizontal rib 31 of this panel for passing a floor anchor A. A single vertical opening 42 is provided in the horizontal top web 33 of this corner panel for passing a roof-attaching bolt, as already described.

Along its right side edge in FIG. 10, this corner panel 80 presents a pair of vertically spaced, horizontal openings which register with the two horizontal openings in the adjacent side of the adjoining standard-width panel, and here the two panels are bolted together to provide part of the same wall of the building.

To the left of its inside recesses 38 the corner panel 80 presents a side edge segment 81 which is relatively thick from side to side. At this side edge segment the corner panel is formed with two vertically spaced, horizontal, upper and lower openings which extend perpendicular to the opposite major faces of this panel. These openings register with corresponding openings 43, 44 formed in the adjacent side edge rib 34 of a standard wall panel 23 whose right side edge in FIG. 11 abuts against the inside major face of the corner panel 80 at its left side edge segment 81. Clamping bolts B extend through these registering holes in these two panels so that the panels are clamped together at right angles to each other.

Referring to FIG. 12, where an inside wall of the building adjoins an outside wall the just-described corner panel 80 may be engaged at one end between two standard wall panels 23 of the outside wall. This corner panel 80 extends normal to the adjoining outside wall and forms the beginning of the inside wall of the building. The left side edge segment 81 of the corner panel 80 is sandwiched between the adjacent side edges of the outside wall panels 23. It presents two vertically spaced, horizontal holes 82 (FIG. 14) which register respectively with the lower openings 43, 45 in the adjacent side edge ribs of the adjoining standard wall panels 23 and with the corresponding upper openings 44, 46 (not shown) in these side edge ribs. Clamping bolts B extend through these aligned openings, as shown in FIG. 14, to hold the outside wall panels 23 and the inside corner panel 80 clamped together, with the inside corner panel extending perpendicular to the panels of this outside wall of the building.

FIG. 12 shows an inside doorway panel 90 located between the just-described inside corner panel 80 and an interior standard wall panel 23 extending parallel to the outside wall to which this inside corner panel 80 is attached. This inside doorway panel 90 presents opposite, vertically elongated side segments 91, 92 and a top segment 93 joining them. The left side segment 91 of the inside doorway panel is formed with a vertically spaced pair of horizontal holes at 94 and 95, which register respectively with corresponding openings formed in the adjoining side edge rib 34 of the corner panel 80. Clamping bolts B are received in these aligned sets of openings for holding these two panels together.

Similar horizontal openings are formed in the right side edge segment 92 of the inside doorway panel 90, and these openings register individually with openings which are formed at 96 and 97 in the left side edge rib 35 of the standard wall panel 23 and extend between the opposite major faces of panel 23 at this rib. Clamping bolts hold this wall panel 23 against this edge of the inside doorway panel 90, with these two panels extending perpendicular to one another.

Multi-story Building Construction

FIG. 51 shows the manner in which wall panels according to the present invention may be embodied in a multi-story building.

In the first story of this building, a standard wall panel 23 and a half-width corner panel 80 are bolted to the floor 20 and to each other to form a right-angled outside corner of the building. A second standard wall panel 23 is connected end-to-end to the corner panel 80 as part of the same outside wall, in the manner already described in detail.

A flat, reinforced concrete panel 100 provides the first-story ceiling and the second-story floor of this building.

At its periphery this floor panel 100 presents a downwardly-facing recess 101 (FIG. 16) of rectangular cross-section which snugly receives the upper ends of the respective first-story wall panels. The depth of this recess 101 inward from the adjacent peripheral edge 102 of panel 100 is equal to the front-to-back thickness of the upper end of each first-story wall panel, so that the peripheral edge 102 of floor panel 100 is flush with the outside face 28 of the first-story wall panels.

The floor panel 100 also presents at each peripheral edge an upwardly-facing recess 103 of rectangular cross-section which snugly receives the lower ends of the respective second-story wall panels. The depth or recess 103 inward from the adjacent peripheral edge 102 of the floor panel is equal to the front-to-back thickness of the lower end of each second-story wall panel, so that the peripheral edge 102 of the floor panel is flush with the outside face 28 of each second-story wall panel.

At each vertical hole in the first-floor wall panels and each correspondingly positioned hole in the second-floor wall panels the floor panel 100 between them is formed with a hole 104 (FIG. 16) which registers with both the hole in the second-floor wall panel above and the hole in the first-floor wall panel below.

A clamping bolt B, as already described, is inserted down through these registering vertical openings and a nut is threaded onto the lower end of this bolt to clamp the floor panel 100 and the second-floor wall panel down against the top of the first-floor wall panel.

With this arrangement the second-story floor panel 100 and the upper and lower wall panels fit together so that they buttress each other and provide a water tight seal where they are joined together. Preferably, a sealer of epoxy resin or the like is provided between the adjoining surfaces of this joint.

A building wall made up of the present wall panels can be erected rapidly in a fool-proof manner. The standard wall panels 23 are symmetrical, so that either short edge can be at the bottom and the opposite short edge at the top. The wall panels are readily attached to each other, to the floor, and to the roof or the floor panel above, and accurate alignment of the panels is assured because of the panels rigidity due, in part, to the reinforcing rod framework in each panel.

We claim:

1. In a building, a wall structure having a plurality of precast, reinforced concrete wall panels adjoining each other in succession, each of said wall panels having opposite peripheral sides and transverse bolt holes in each of said sides, with the bolt holes in the neighboring sides of adjoining panels registering with each other, and clamping bolt and nut assemblies at the registering bolt holes in adjoining panels for holding said panels together, the improvement wherein said bolt and nut assemblies are operatively coupled to the respective peripheral sides of the panels to apply compression to the concrete in said sides adjacent the respective bolt holes, and further comprising a rigid reinforcing framework embedded in each panel and comprising in each of said opposite peripheral sides of the panel:

a pair of front and back rigid reinforcing rods embedded in said side of the panel and elongated lengthwise of said side, the rods of each pair passing respectively in front of and behind said bolt holes in that side;

and means rigidly positioning said rods embedded in the respective sides of said panel to withstand the compression applied to the sides of the panels by the respective bolt and nut assemblies.

2. A building wall structure according to claim 1, wherein said last-mentioned means in each wall panel comprises short rod elements embedded in the respective panel and extending from front to back between the pair of front and back rods in each peripheral side of said panel at spaced locations therealong, said short rod elements being rigidly connected to the front and back rods of the respective pair to maintain the latter spaced apart from front to back in said panel.

3. A building wall structure according to claim 1, and further comprising in at least certain of said wall panels a plurality of pairs of front and back, elongated rods extending from side to side in the respective panel and rigidly interconnecting the front rods and the back rods in the opposite peripheral sides of said panel at different locations along the length of said sides.

4. A building wall structure according to claim 3 wherein said pairs of interconnecting rods include in each panel a lower pair of rods extending from side to side along the bottom of the respective panel, and said panel has bolt holes in the bottom which extend up between said lower pair of interconnecting rods.

5. A building wall structure according to claim 3, wherein said pairs of interconnecting rods include in each panel an upper pair of rods extending from side to side along the top of the respective panel, said panel having bolt holes in the top which extend down between said upper pair of interconnecting rods.

6. A building wall structure according to claim 1, wherein said wall panels extend vertically and form an outside building wall, and further comprising an upstanding corner panel joined to said outside wall at one end and extending perpendicular thereto, said corner panel being a precast, reinforced body having horizontal top and bottom edges and perpendicular opposite side edges and perpendicular opposite side edges, said corner panel having a rectangular corner recess along its entire height which extends inward from one of said side edges and forward from the back of the adjoining end panel of said outside wall and snugly receives the adjacent side of said end panel, said corner panel having horizontal bolt holes extending forward therethrough in front of said corner recess and registering with the bolt holes in the adjacent side of said end panel of the outside wall, clamping bolts extending through said registering bolt holes in the corner panel and said end panel of the outside wall, and nuts threaded onto said last-mentioned bolts and holding the adjoining portions of said corner panel and said end panel of the outside wall under compression which is taken up the reinforcing rods in said adjacent side of said end panel.

7. A building wall structure according to claim 1, wherein said side wall panels extend vertically and form an outside building wall, and further comprising an upstanding inside building wall extending perpendicular to said outside wall intermediate the latter's length, said inside wall having an upstanding, precast, reinforced concrete, corner panel sandwiched at one side thereof between neighboring side edges of adjacent panels of said outside wall, said corner panel having horizontal bolt holes extending from front to back therethrough and registering with the bolt holes in said neighboring side edges of said adjacent panels of said outside wall, clamping bolts extending through said registering bolt holes in said adjacent panels of said outside wall and said corner panel of said inside wall, and nuts threaded onto said last-mentioned bolts and holding the adjoining portions of said corner panel and said adjacent panels of said outside wall under compression which is taken up by the reinforcing rods in said adjoining portions of said adjacent panels of said outside wall.

8. A building wall structure according to claim 1, wherein said side wall panels extend vertically and form an outside building wall, and further comprising a similar, upstanding, upper building wall located directly above said first-mentioned wall, and a horizontal, precast, reinforced concrete, upper floor panel sandwiched between said upstanding walls, said floor panel presenting a downwardly-facing rectangular recess which snugly receives the top of said first-mentioned wall and an upwardly-facing rectangular recess spaced above said upper wall, and means for bolting said floor panel to the respective panels of said upstanding walls.

9. In a building, a side wall having a plurality of upstanding, rectangular, precast, reinforced concrete wall panels extending side-by-side in succession, each of said panels having horizontal top and bottom edges, the improvement which comprises a rigid reinforcing rod framework embedded in each panel and comprising: a first pair of front and back, vertically elongated, rigid rods extending down along the respective panel adjacent one of said side edges; a second pair of front and back, vertically elongated, rigid rods extending down along the respective panel adjacent the opposite side edge; and upper pair of front and back rigid rods which are horizontally elongated from side to side in the respective panel adjacent said top edge, the front rod of said upper pair extending between and being joined to the respective front rods of said first and second pairs, the back rod of said upper pair extending between and being joined to the respective back rods of said first and second pairs; and short rod segments extending from front to back in the respective panel between the front and back rods of each pair at spaced locations on the framework, said short rod segments being joined to and spacing apart the front and back rods of each pair;

each panel having bolt holes extending horizontally inward from each of said opposite side edges of the panel between the front and back rods of the adjacent vertically elongated pair, each of said bolt holes being accessible at its inner end from the back of the panel, and the bolt holes in the neighboring sides of adjoining panels registering with each other;

clamping bolts extending through the registering bolt holes in adjoining panels; and nuts threaded onto said bolts for holding the adjoining sides of said panels clamped to each other and applying compression to the concrete in said neighboring sides of adjoining panels which is taken up by the corresponding front and back rods embedded in the concrete on either side of each bolt hole.

10. A building wall according to claim 9, wherein each panel has vertical bolt holes extending down from its top edge between the front and back rods of said upper pair, said vertical bolt holes being spaced apart along said top edge of the panel and being accessible at their lower ends from the back of the panel.

11. A building wall according to claim 6, wherein at least certain of said wall panels have a lower section formed with vertically elongated, integral, concrete ribs respectively extending along its opposite side edges and spaced inward from said side edges on the back of the respective panel, said lower section of the panel having a horizontally elongated, integral, concrete rib along its bottom edge on the back which is joined to the lower ends of said vertically elongated ribs, said last-mentioned rib having bolt holes which extend up from the bottom edge of the panel and have their upper ends accessible at the top of said last-mentioned rib from the back of the panel, said panel having a horizontally elongated, integral, concrete rib at substantially the middle of the panel on the back which is joined to said vertically elongated ribs, and wherein said reinforcing framework presents pairs of front and back elongated rods which are embedded respectively in all said ribs, with the rods in said rib along the bottom edge of the panel passing respectively in front of and behind said bolt holes in that rib.

12. A building wall according to claim 11, wherein at least some of said wall panels with said lower section also have an upper section which extends up from said horizontally elongated rib at the middle of the panel, said upper section of the panel having vertically elongated, integral, concrete ribs on the back which extend respectively along its opposite side edges and at locations laterally inward from said side edges, and a horizontally elongated, integral, concrete rib on the back which extends along said top edge of the panel and is joined to the upper ends of said last-mentioned vertically elongated ribs, said last-mentioned rib having bolt holes extending vertically therethrough which have their lower ends accessible from the back of the panel, and wherein said reinforcing framework presents pairs of front and back elongated rods which are embedded respectively in said ribs on the back of said upper section of the panel, with said rods in the rib along the top edge of the panel passing respectively in front of and behind said bolt holes in that rib.

* * * * *